United States Patent [19]

Potts

[11] 4,078,695

[45] Mar. 14, 1978

[54] EASY-OPENING CAN END AND METHOD OF OPENING

[75] Inventor: Vinson S. Potts, Cherry Hill, N.J.

[73] Assignee: Crown Cork & Seal Company, Inc., Philadelphia, Pa.

[21] Appl. No.: 741,664

[22] Filed: Nov. 15, 1976

Related U.S. Application Data

[63] Continuation-in-part of Ser. No. 596,530, Jul. 16, 1975, abandoned.

[51] Int. Cl.[2] ..... B65D 41/32

[52] U.S. Cl. ..... 220/269; 220/258; 220/271; 220/336; 222/541

[58] Field of Search ..... 220/258, 259, 260, 265, 220/266, 271, 334, 336, 337, 268, 359, 269; 222/541, 484; 229/7 R

[56] References Cited

U.S. PATENT DOCUMENTS

| | | | |
|---|---|---|---|
| 3,106,311 | 10/1963 | Fairchild | 220/307 |
| 3,800,971 | 4/1974 | LaVista | 220/240 X |
| 3,813,000 | 5/1974 | Underwood | 220/269 |
| 3,843,011 | 10/1974 | Perry | 220/269 X |
| 3,871,550 | 3/1975 | Chiappe | 220/359 |
| 3,910,453 | 10/1975 | Knevseh et al. | 220/334 X |

*Primary Examiner*—George T. Hall

*Attorney, Agent, or Firm*—Woodcock, Washburn, Kurtz & Mackiewicz

[57] ABSTRACT

An easy-opening can end includes a dispensing opening and a vent hole covered by a pivoting tab located on the interior side of the end. The pivoting tab is adapted to be pushed inwardly so as to break the seal at the dispensing opening and subsequently pivoted to the open position in response to movement of a finger engageable portion.

73 Claims, 33 Drawing Figures

EASY-OPENING CAN END AND METHOD OF OPENING

RELATED APPLICATIONS

This is a continuation-in-part of application Ser. No. 596,530 filed July 16, 1975, now abandoned.

BACKGROUND OF THE INVENTION

This invention relates to easy-opening can ends of the type utilized on beer and beverage cans which permit opening of the cans without the use of a separate tool or opening device.

Heretofore, various easy-opening can ends utilizing pivoting tabs have been proposed. The pivoting tab has been considered to be particularly desirable in that it avoids the necessity for partially preforming a dispensing opening and/or vent hole by scoring or otherwise weakening a predetermined area of the can end. As a consequence, the pivoting tab may be utilized on an all-steel end which does not lend itself to the use of a partially preformed dispensing opening and/or vent hole by scoring or weakening due to the strength of the steel.

U.S. Pat. No. 3,622,055 — Douty discloses a pivoting tab in a steel can end having a dispensing opening and a vent hole. The tab is pivotally attached to the exterior side of the can end with portions of the tab extending into the dispensing opening and the vent hole and sealingly engaged at the under side of the can end along the edges of the dispensing opening and the vent hole. Can ends of this type may be particularly difficult to open since the seal at the dispensing opening and the vent hole may provide a good deal of resistance. Another can end having a pivoting tab is disclosed in U.S. Pat. No. 3,106,311 — Fairchild wherein portions of the tab must be removed from positions of sealing engagement with the dispensing opening by pulling upwardly on the tab prior to pivoting to the open position.

Another approach to easy-opening can ends which does not rely upon partially preformed dispensing openings is disclosed in U.S. Pat. No. 3,800,971 — LaVista wherein the tab comprises a plug which is pushed inwardly for opening. Pushin plugs are also disclosed in copending application Ser. No. 522,097 filed Nov. 8, 1974 and Ser. No. 513,723 filed Oct. 10, 1974 and assigned to the assignee of this invention.

SUMMARY OF THE INVENTION

It is therefore an object of this invention to provide an easy-opening can end which does not require the partial preforming of a dispensing opening and/or vent hole by scoring or otherwise weakening the end panel.

It is a more specific object of this invention to provide an easy-opening can end having a pivoting tab which may be opened with relative ease.

In accordance with this invention, a can of the easy-opening type comprises a can body and an end panel attached to the body. The end panel includes a dispensing opening and a vent hole communicating with the interior of the can body. A closure tab is pivotally mounted on the end panel and includes a closure portion sealingly engaging the end panel on the interior side thereof adjacent the dispensing opening and the vent hole with the closure portion extending on the interior side of the end panel from the dispensing opening to the area of pivotal attachment to the end panel. The tab further comprises a finger engageable portion on the exterior of the end panel so as to permit the closure portion to be pivoted from the closed position to the open position.

In accordance with one important aspect of the invention, the dispensing opening in the tab permits the closure portion to be pushed inwardly so as to break the seal between the closure portion and the end panel adjacent the dispensing opening thereby facilitating subsequent pivoting of the closure tab.

In one embodiment of the invention, the finger engageable portion extends along the exterior of the end panel away from the pivotal point. The finger engageable portion extends over the dispensing opening and cooperates therewith when pushed toward the interior of the can so as to break the seal between the closure portion and the interior side of the end panel. In order to assist in breaking the seal, the finger engageable portion includes a projection capable of extending into the dispensing opening. The vent hole may be located adjacent the point of pivotal attachment so that the vent hole is covered by the closure portion when the tab is in the closed position. In order to prevent accidental opening of the can, the end panel may include an outwardly raised area adjacent the closure portion when the tab is in the closed position. The outwardly raised portion may have an inclined surface which cooperates with the finger engageable portion for producing a pivotal motion of the closure tab as the finger portion is pushed inwardly toward the closure portion to break the seal at the dispensing opening.

In another embodiment of the invention, the end panel includes a tab opening located between the dispensing opening and the point of pivotal attachment and the finger engageable portion extends through the tab operating opening. The closure portion extends through the tab operating opening. The closure portion sealingly engages the end panel at the interior side thereof adjacent the dispensing opening and the tab operating opening. The tab may also include an attachment portion which extends through an attachment opening in the end panel. The attachment portion may be pushed inwardly for venting.

The foregoing embodiments may comprise closure tabs made from different material. For example, the closure tabs may comprise a unitary plastic configuration. Or, the closure tab may comprise a metallic structure having a flexible tapelike sealing material overlapping the edges of the closure portion and in sealing engagement with the end panel.

Figure 5:
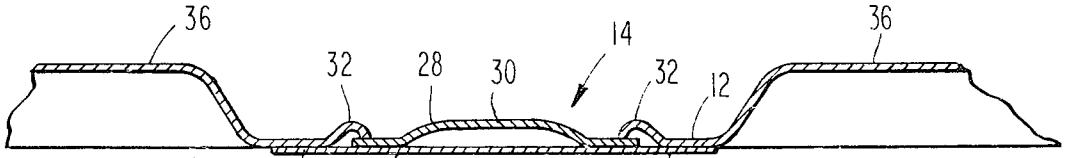
FIG. 5 is a sectional view of the can end of FIG. 1 taken along line 5—5.
Figure 5A:
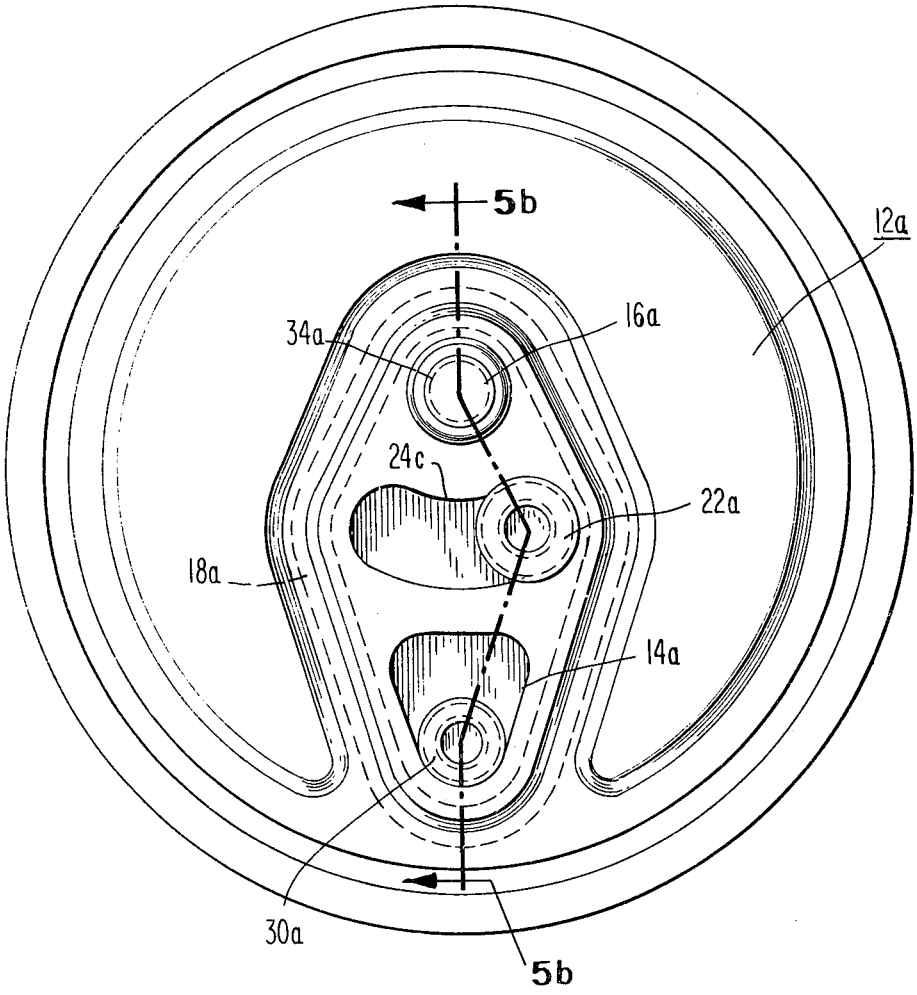

FIG. **5*a*** is a plan view of an alternative tab;

FIG. **5*b* is a sectioanl view of the tab shown in FIG. 5*a*;**

Figure 6:
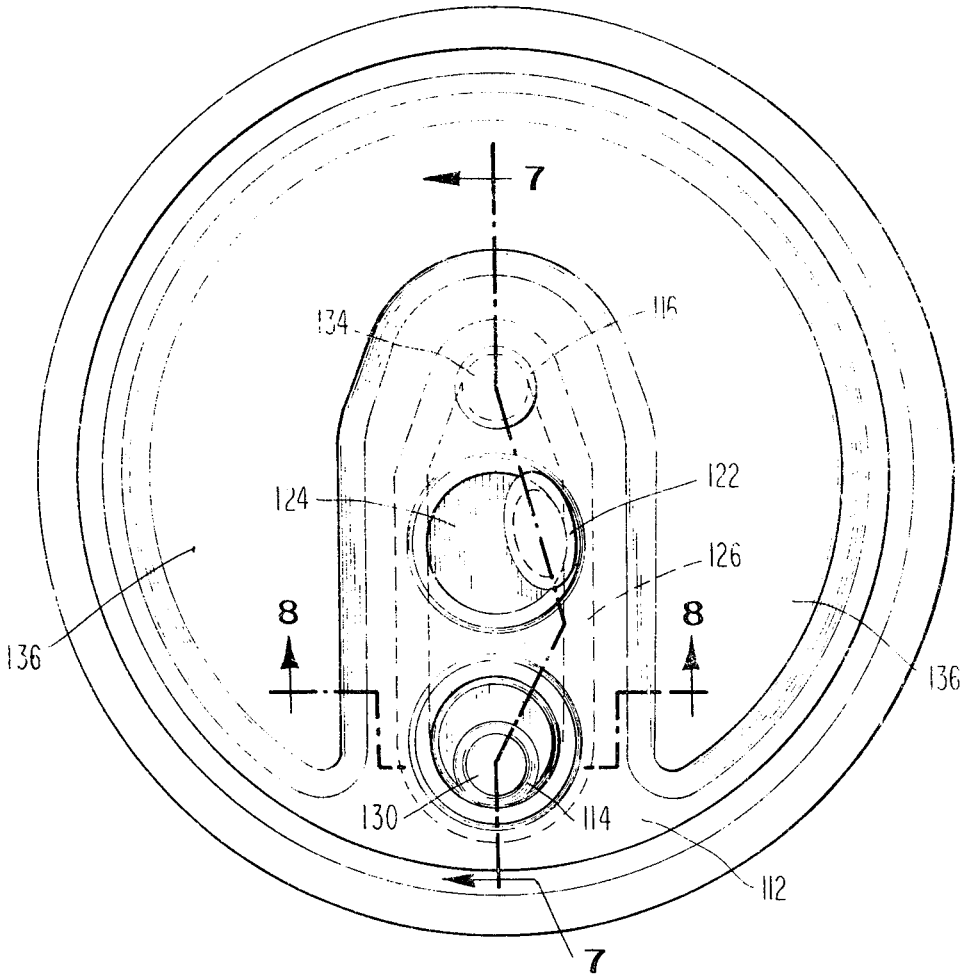
Figure 7:
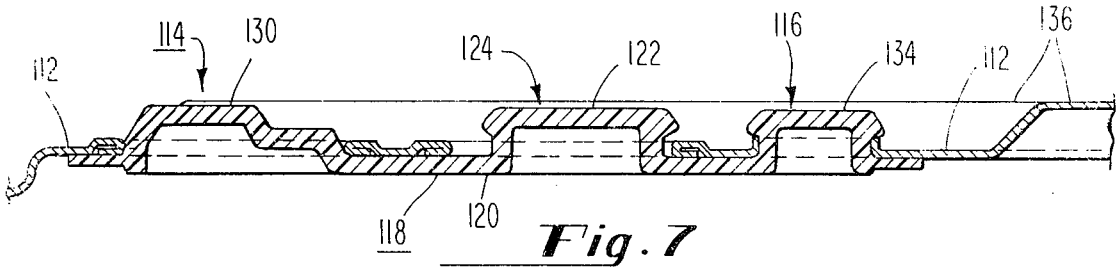
Figure 8:
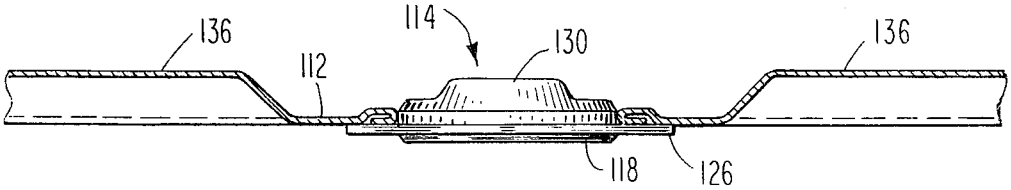
Figure 9:
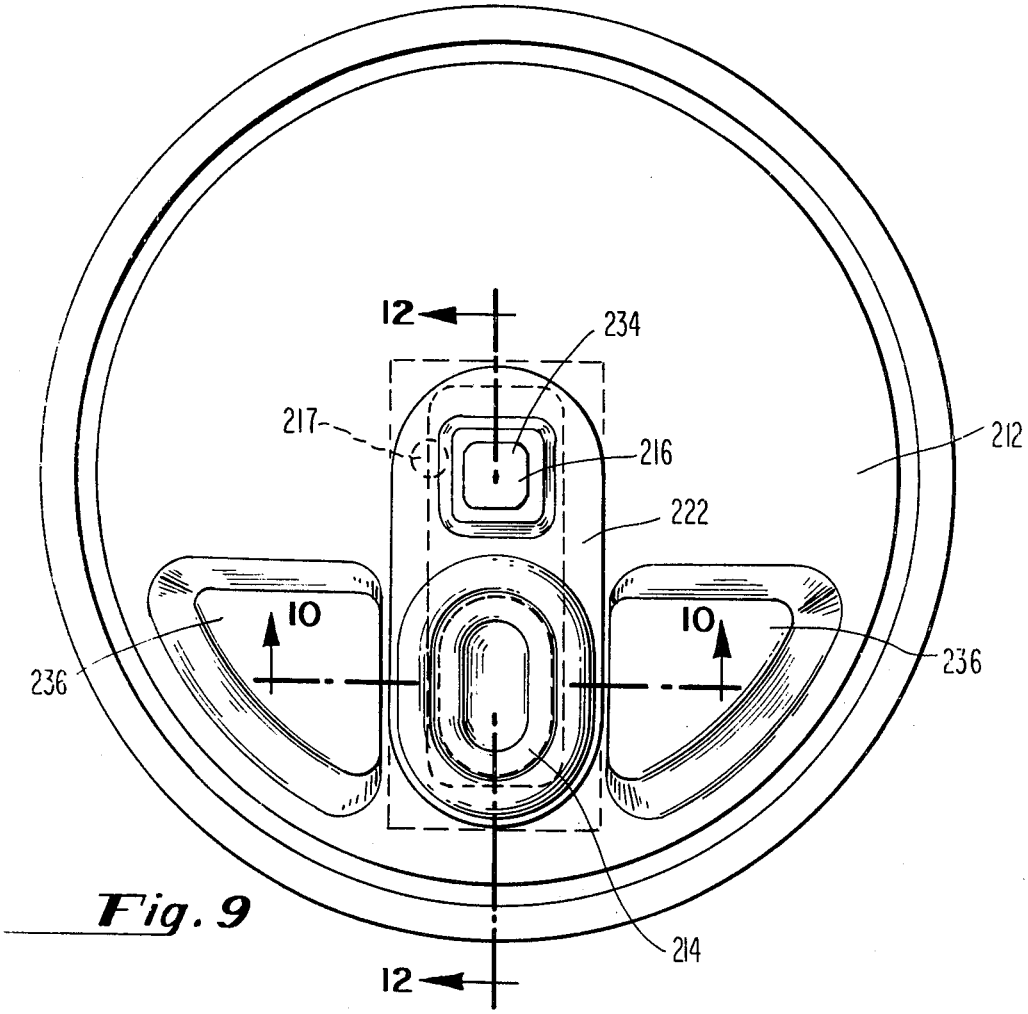
Figure 10:
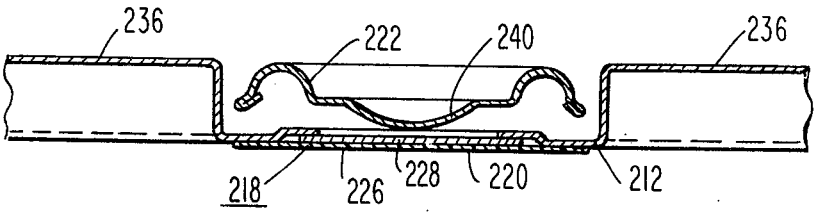
Figure 11:
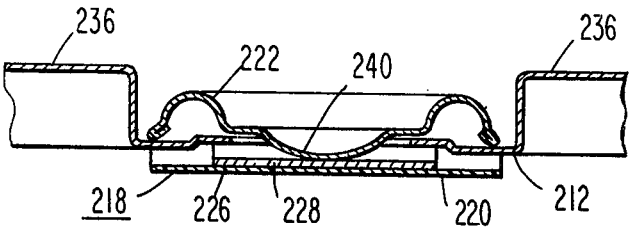
Figure 12:
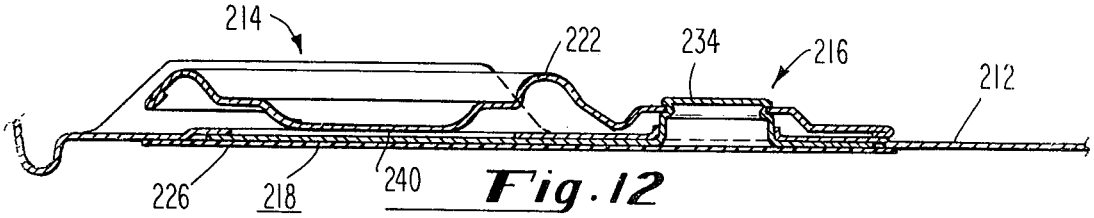
Figure 13:
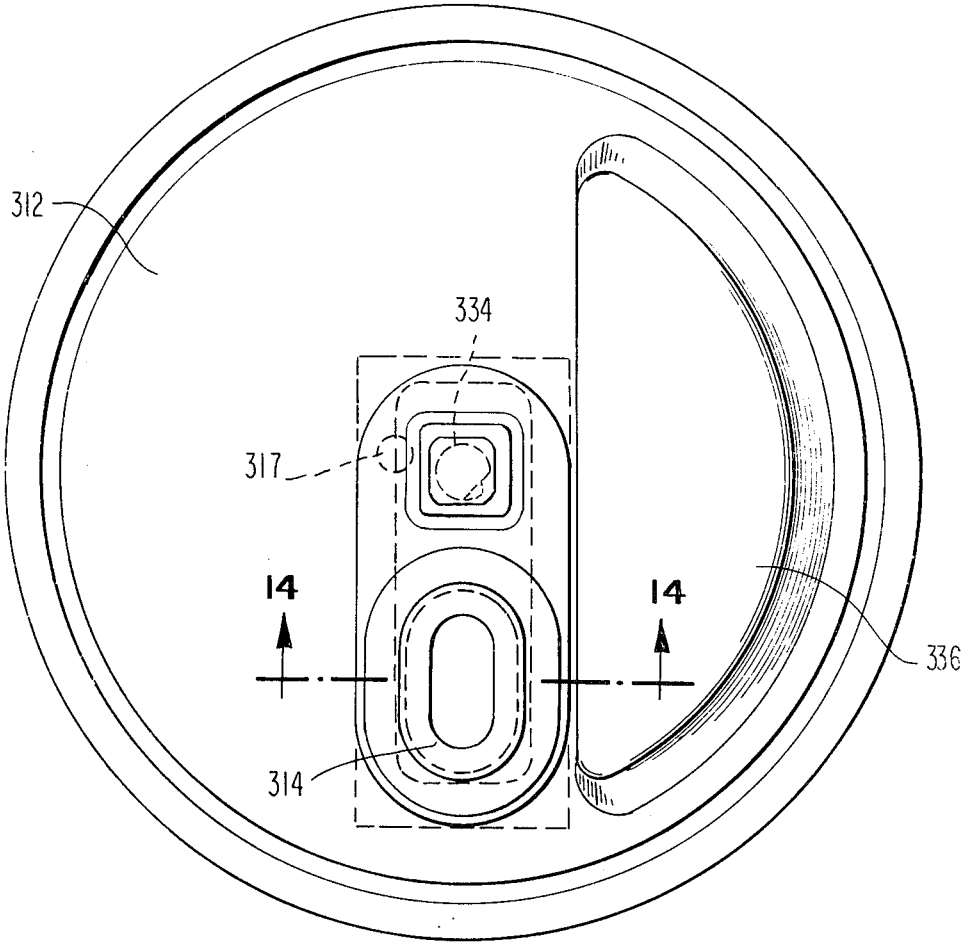
Figure 15:
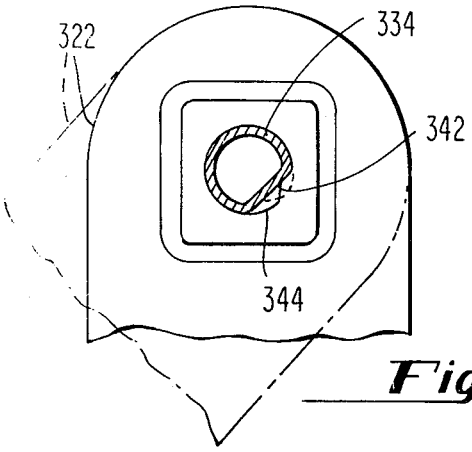
Figure 14:
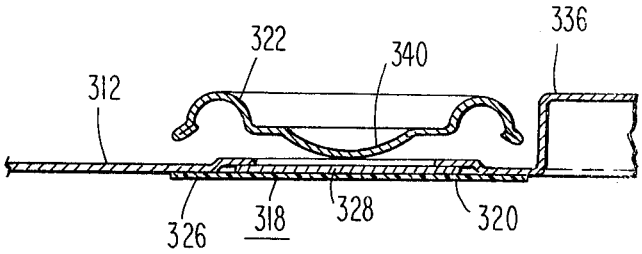
Figure 16:
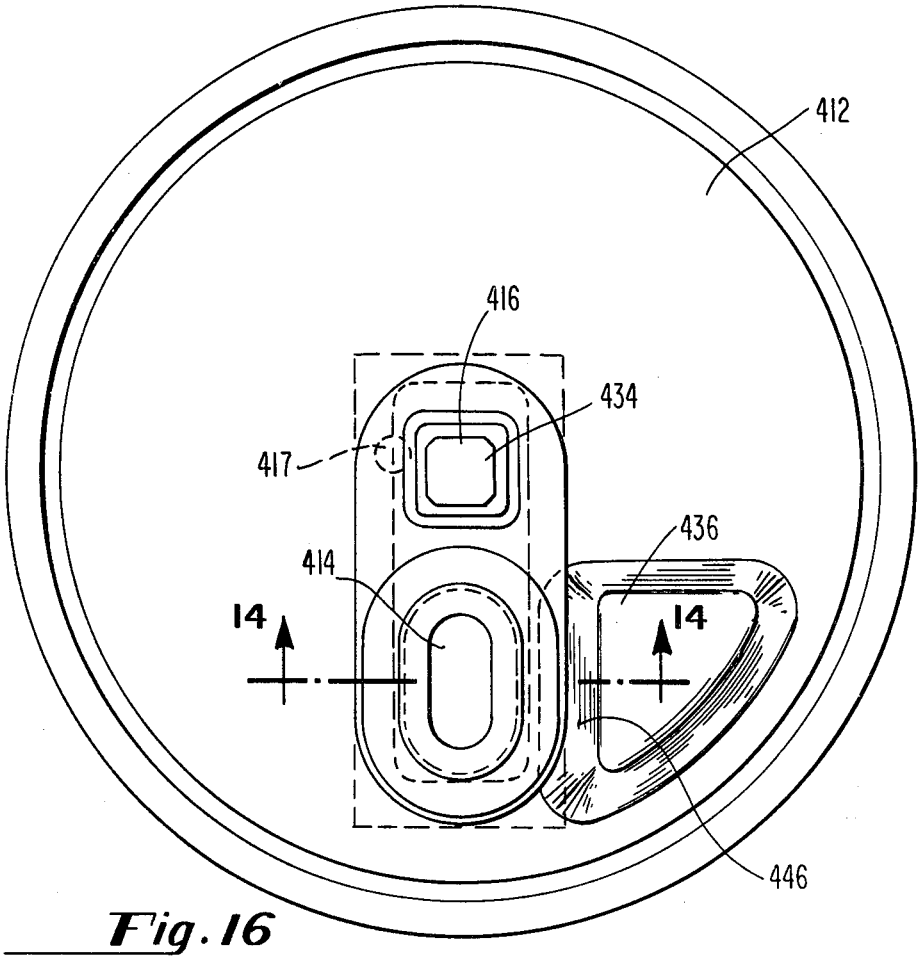
Figure 17:
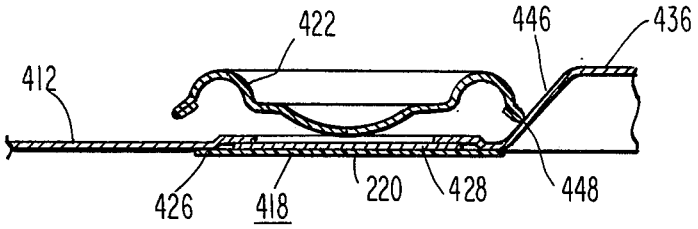
Figure 18:
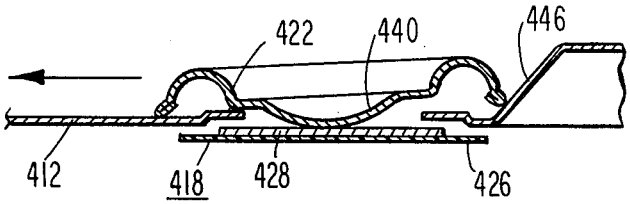
Figure 19:
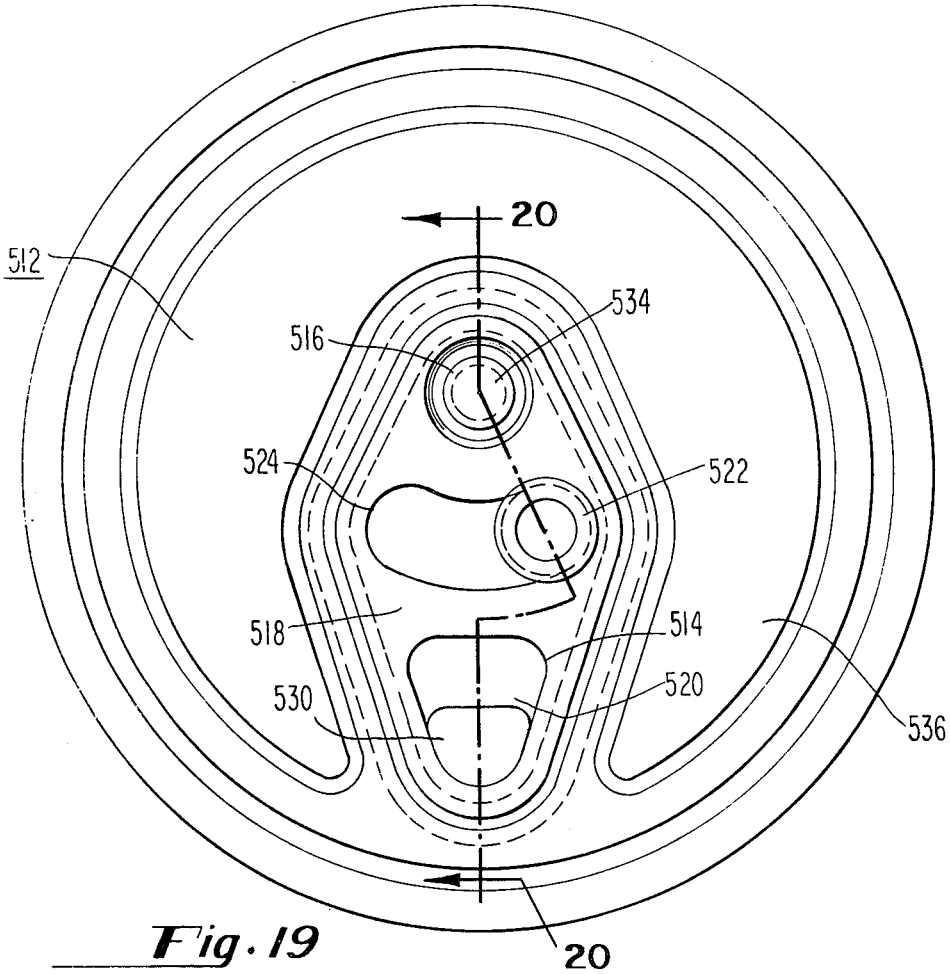
Figure 20:
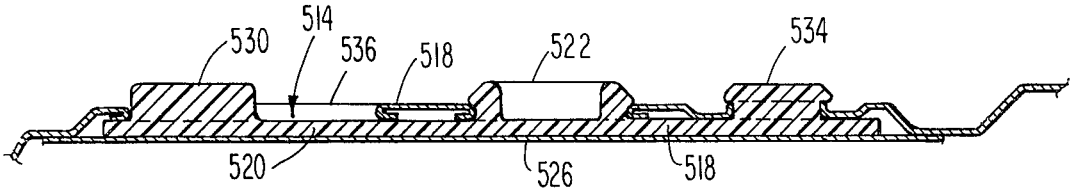
Figure 21:
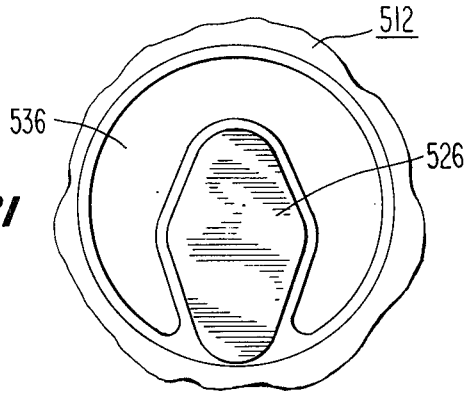
Figure 22:
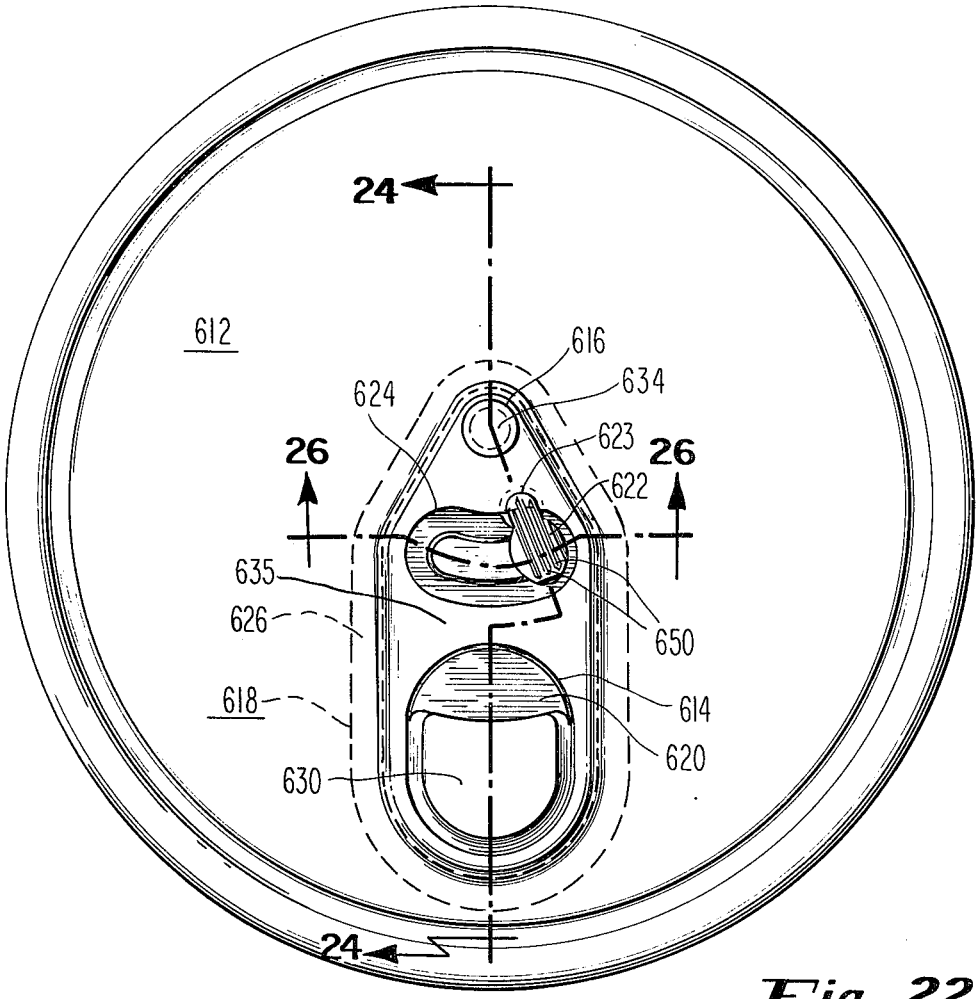
Figure 23:
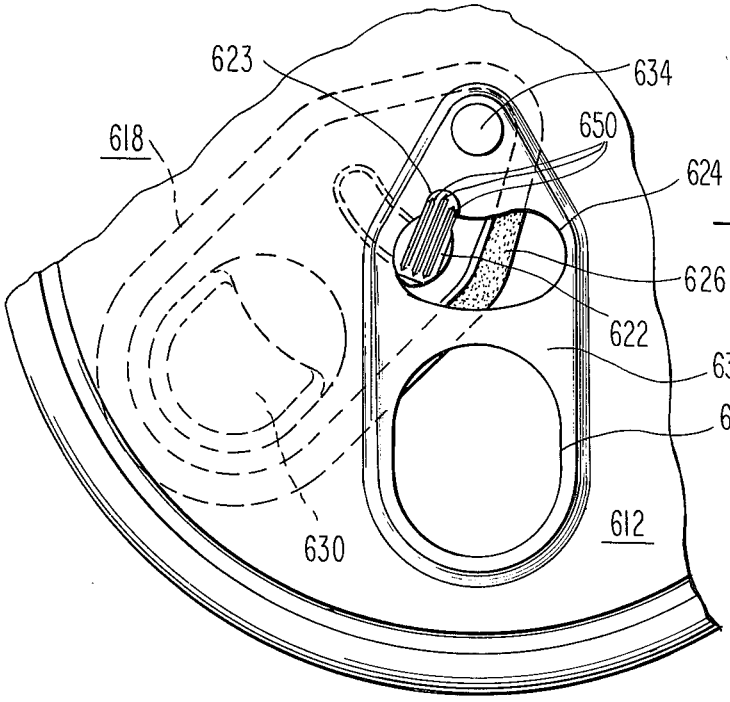
Figure 24:
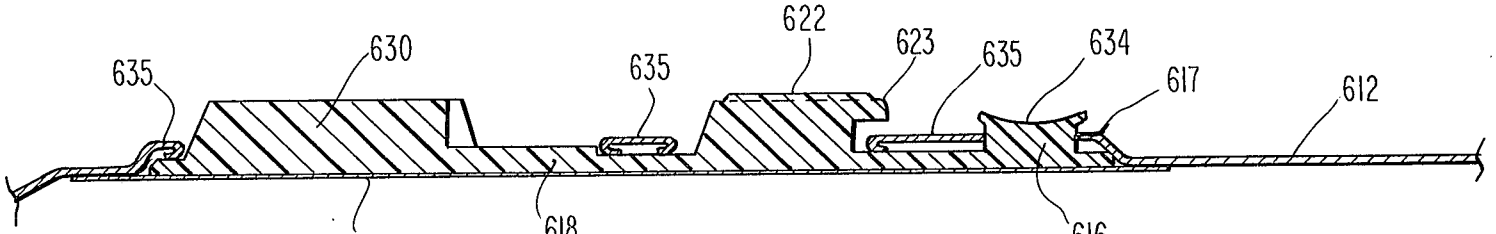
Figure 25:
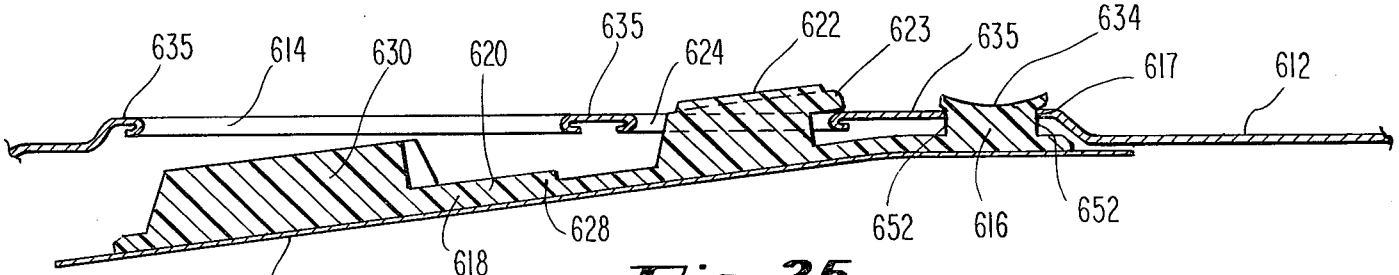
Figure 26:
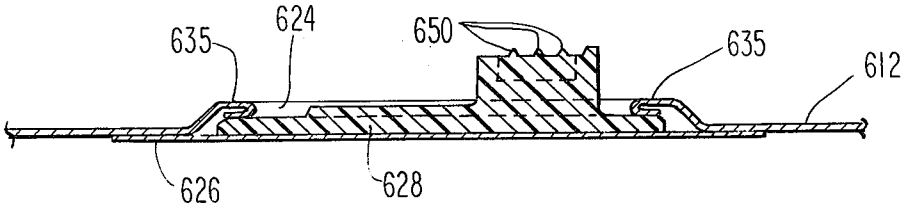

FIG. 6 is a plan view of the can representing another embodiment of the invention;

FIG. 7 is a sectional view of the can end of FIG. 6 taken along line 7—7;

FIG. 8 is a sectional view of the can end of FIG. 6 taken along line 8—8;

FIG. 9 is a plan view of another embodiment of the invention;

FIG. 10 is a sectional view taken along line 10—10 of FIG. 9 when the can end is closed;

FIG. 11 is a sectional view of the can end of FIG. 9 taken along line 10—10 when the can end is open;

FIG. 12 is a sectional view of the can end of FIG. 9 taken along line 12—12;

FIG. 13 is a plan view of another can end representing an embodiment of the invention;

FIG. 14 is a sectional view of the can end of FIG. 13 taken along line 14—14;

FIG. 15 is a partial plan view of the under side of the closure tab at the point of pivotal attachment;

FIG. 16 is a plan view of a can end representing another embodiment of the invention;

FIG. 17 is a sectional view of the can end of FIG. 16 taken along line 17—17 during opening;

FIG. 18 is a sectional view of the can end of FIG. 16 taken along line 17—17 during opening;

FIG. 19 is a plan view of a can end representing yet another embodiment of the invention;

FIG. 20 is a sectional view of the can end of FIG. 19 taken along line 20—20 prior to opening;

FIG. 21 is a bottom view of the can end of FIG. 19 prior to opening;

FIG. 22 is a plan view of a can end representing a further embodiment of the invention;

FIG. 23 is a partial plan view showing the can end of FIG. 22 in the open state;

FIG. 24 is a sectional view of the can end of FIG. 22 taken along line 24—24 and depicting the can end in the closed state;

FIG. 25 is a sectional view of the can end of FIG. 22 taken along line 24—24 and depicting the can end in a semi-open state;

FIG. 26 is a partial sectional view of the can end of FIG. 22 taken along line 26—26.

Figure 27:
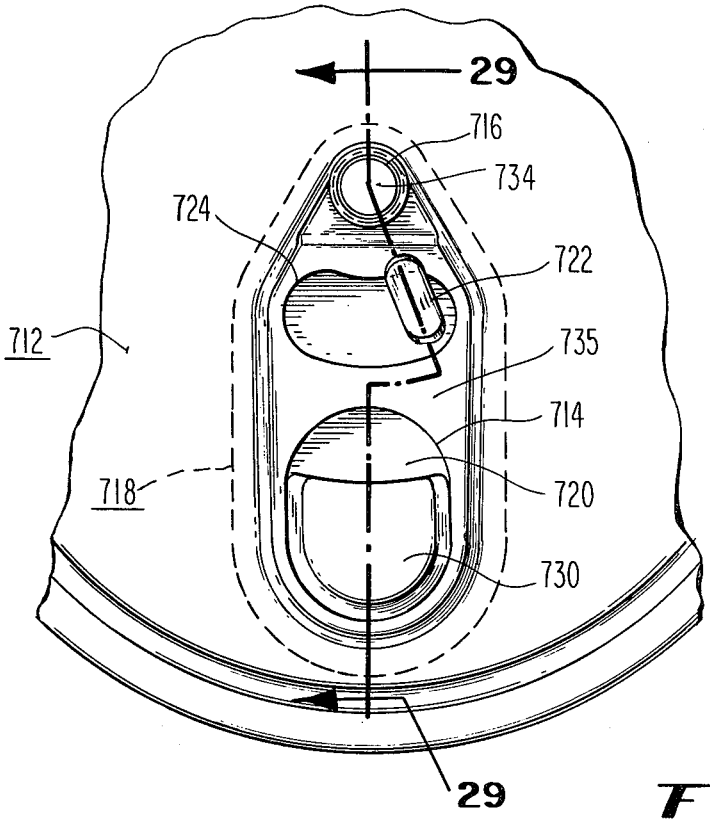
Figure 28:
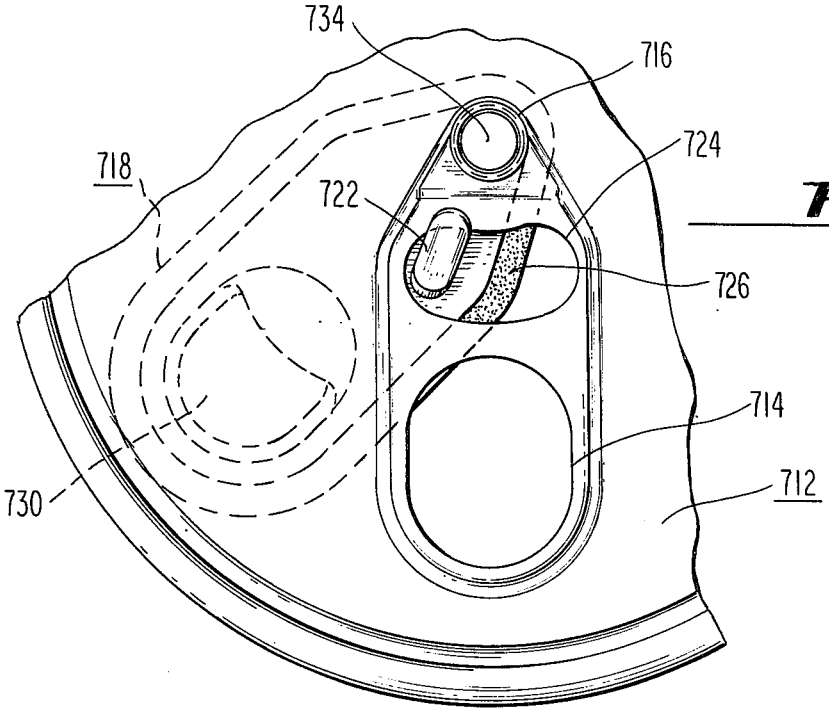
Figure 29:
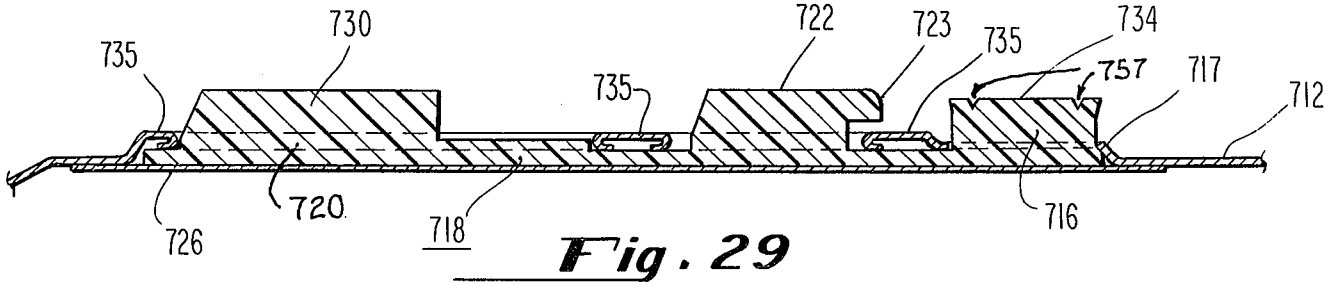
Figure 30:
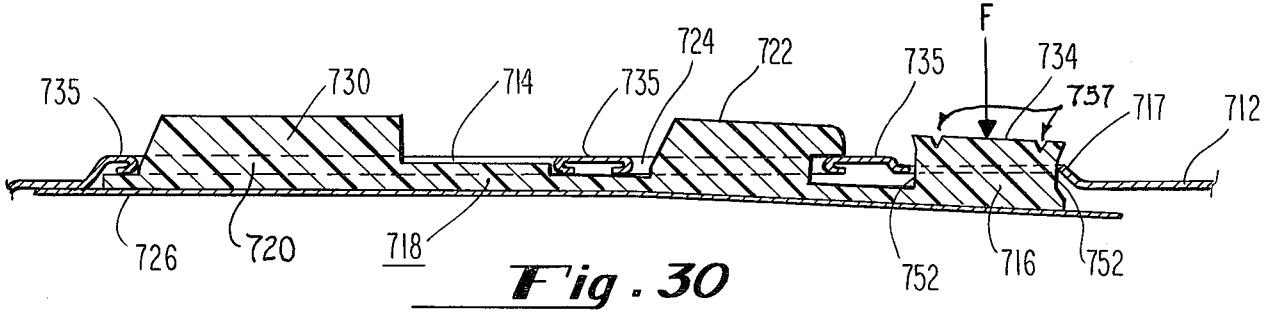
Figure 31:
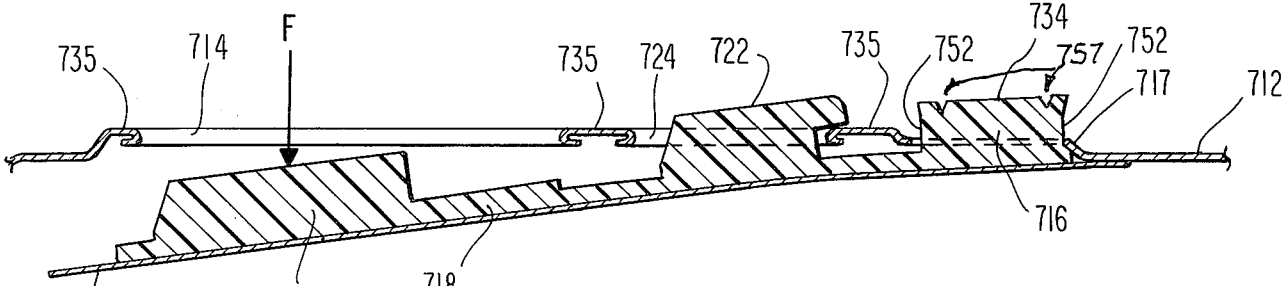

FIG. 27 is a partial plan view of a can end representing a further embodiment of the invention when the can end is in the closed state;

FIG. 28 is a partial plan view showing the can end of FIG. 27 in the open state;

FIG. 29 is a sectional view of the can end of FIG. 27 taken along line 29—29;

FIG. 30 is a sectional view of the can end of FIG. 27 taken along line 29—29 during the first phase of opening; and FIG. 31 is a sectional view of the can end of FIG. 27 taken along line 29—29 during the second phase of opening.

DETAILED DESCRIPTION OF THE PREFERRED EMBODIMENTS

Referring to FIGS. 1-5, an easy-opening can comprises a can body 10 and a can end having an end panel 12 double seamed to the upper end of the can body 10. The end panel 12 includes a dispensing opening 14 adjacent the edges of the end panel and a more centrally located pivotal point of attachment 16 for a pivotal closure tab 18 which pivots about an axis substantially parallel to the axis of the can body 10 and perpendicular to the plane of the end panel.

Figure 3:
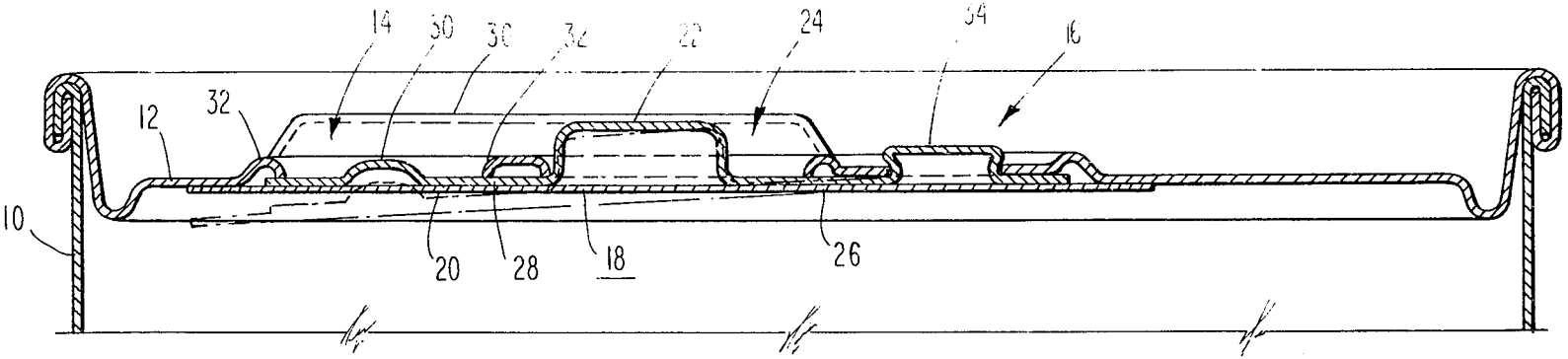
FIG. 3 is a sectional view of the can end of FIG. 1 in combination with a can body taken along line 3—3.
Figure 4:
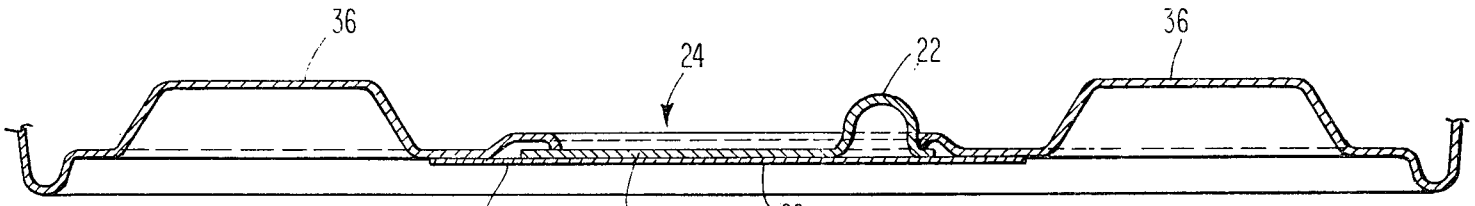
FIG. 4 is a sectional view of the can end of FIG. 1 taken along line 4—4.

The tab 18 comprises a closure portion 20 which extends along the interior side of the end panel 12 from the dispensing opening 14 to the point of pivotal attachment 16. The closure tab 18 further comprises a finger engageable or raised portion 22 which extends through a tab operating opening 24 located between the pivotal point of attachment 16 and the dispensing opening 14. As best shown in FIGS. 3 and 4, the finger engageable portion 22 is asymmetrically positioned within the tab operating opening 24 and extends substantially upwardly above the outer surface of the end panel 12 so as to facilitate the engagement of the portion 22 thereby permitting the closure tab 18 to be pivoted around the point of attachment 16.

The closing portion 20 of the tab 18 sealingly engages the interior side of the end panel 12 at the dispensing opening 14 as well as the tab operating opening 24. In this connection, it will be noted that the tab 20 comprises a flexible tape-like member 26 which extends outwardly beyond the edges of a relatively rigid member 28 of the tab so as to sealingly engage the interior side of the end panel 12. In this embodiment of the invention, the relatively rigid member 28 which has the finger engageable portion 22 integrally formed therewith comprises metal and the flexible tape-like member 26 may comprise PSDX 46 to 49 or Y-8023 manufactured by the 3M Company or similar type manufactured by other companies.

In accordance with another important aspect of the invention, the rigid member 28 of the tab 18 comprises a raised portion 30 which extends upwardly through the dispensing opening 14. The portion 30 is adapted to be engaged by the finger of the opener and pushed downwardly through the dispensing opening 14 so as to break the area of sealing engagement at the dispensing opening 14 with the closure tab 18 in the position shown in FIG. 3. In other words, the substantial area of sealing engagement between the flexible tape-like member 26 and the under side of the end panel 12 at the dispensing opening 14 is broken by pushing downwardly on the raised portion 30. Note that the edges of the dispensing opening 14 comprise a downward curl 32 so as to prevent the cutting of the opener's finger. Further note that the curl 32 forms a raised area 35 surrounding the dispensing opening so as to permit the tab 18 to be substantially recessed upwardly into the raised area 35 with the interior most surface of the member 28 substantially coplanar with the interior surface of the end panel surrounding the raised portion 35.

Figure 1:
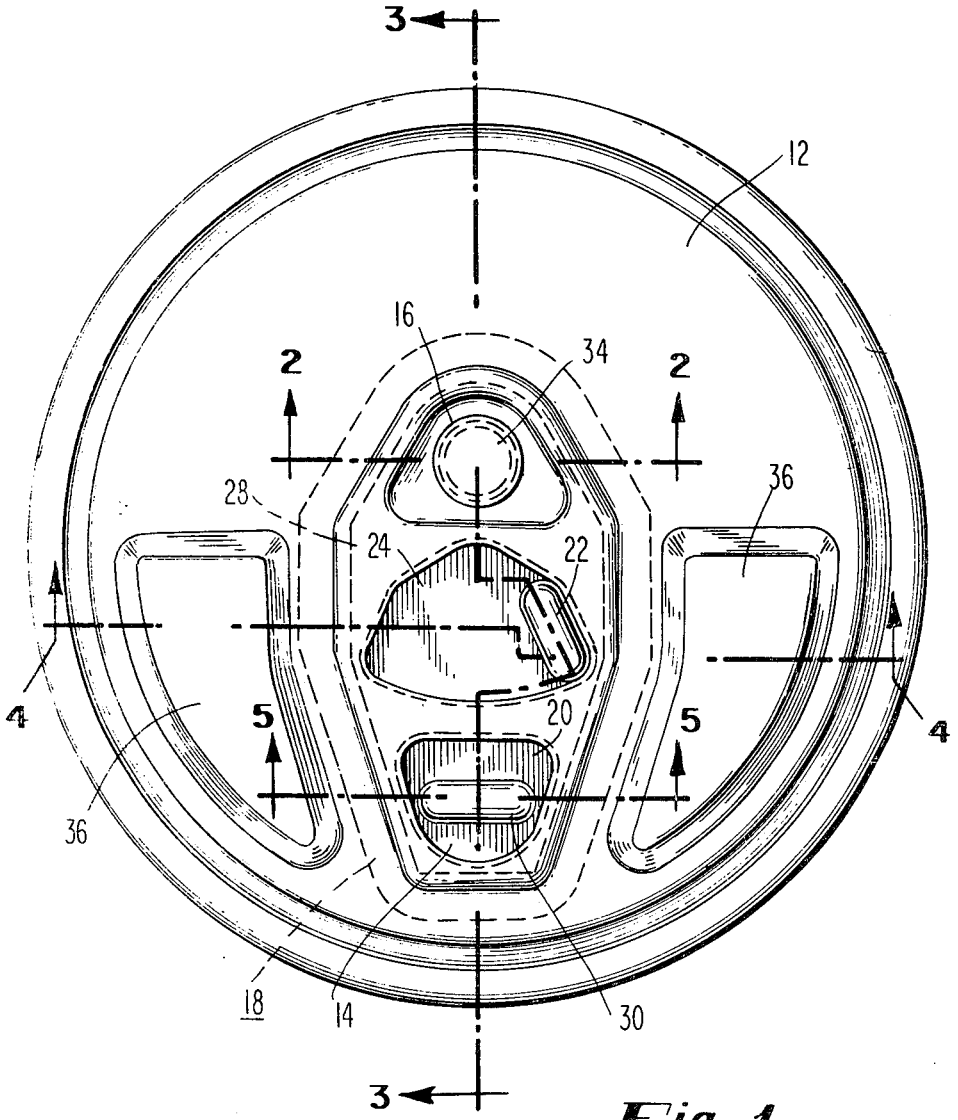
FIG. 1 is a plan view of a can end representing one embodiment of the invention.
Figure 2:
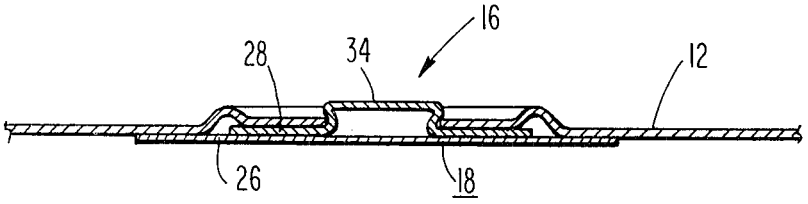
FIG. 2 is a sectional view of the can end of FIG. 1 taken along line 2—2.

As shown in FIGS. 2 and 3, the tab 18 comprises a rivet 34 having a flared portion integrally formed with the metallic member 28 at the pivotal point of attachment 16. The rivet 34 extends through a hole or opening 17 in the end panel 12 and the flared portion extends laterally outwardly beyond the periphery of the attachment hole 17. Note that the flexible tape-like member 26 extends outwardly from the metallic member 28 so as to sealingly engage the under side of the end panel 12 adjacent the point of pivotal attachment 16. Thus the tab 18 sealingly engages the under side of the end panel 12 along the entire length thereof.

In accordance with this invention, the can is opened in two steps. First, the seal at the dispensing opening 14 and at the tab operating opening 24 is broken by pushing the tab 18 inwardly with the application of downward pressure on the raised portion 30 at the dispensing opening 14 as shown in phantom in FIG. 3. Once the sealing engagement between the tab 18 and the under side of the end panel 12 are broken at these points, the tab may be pivoted with relative ease from the closed position shown in FIG. 1 to an open position by applying pressure to the raised finger engageable portion 22 remaining above the exterior of the end panel as shown in FIG. 3 in a plane substantially parallel to the plane of the end panel. It will of course be appreciated that breaking the seal of the closure tab without first pushing inwardly on the raised portion 30 by the mere pivotal action would be quite difficult. On the other hand, by pushing inwardly and breaking the seal at the dispensing opening 14 and to a lesser extent at the tab operating opening 24, the only area of sealing engagement which remains is adjacent the point of pivotal attachment 16, and the seal at the point of pivotal attachment 16 may be quite easily overcome due to the leverage afforded by the lever arm of the tab having a fulcrum at the point of pivotal attachment 16. Of course, without breaking the seal at the dispensing opening 14, the mechanical advantage afforded by the tab 18 would be lost. Once the tab 18 is pivoted to the open position, the tab operating opening 24 as well as the attachment hole 17 adjacent the rivet 34 serve as vent holes in the can end 12.

In order to prevent the accidental opening of the can end by an inadvertent downward force on the raised portion 30, the can end 12 comprises raised portions 36 located on opposite sides of the dispensing opening 14 and the tab operating opening 24. The raised portions 36 stand substantially above the raised portion 30 of the tab so that objects which rest upon the top or exterior side of the can end 12 do not come in contact with the raised portion 30 as shown in FIG. 5. In addition, the raised portions 36 of the can end 12 serve to provide additional strength for the end panel.

Figure 5B:
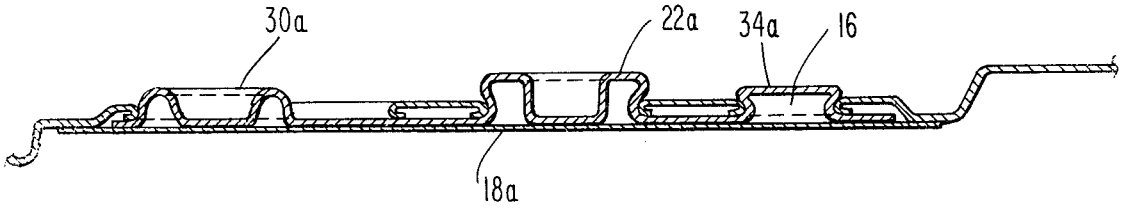

A slightly modified tab 18*a* is shown in FIGS. 5*a* and 5*b*. More particularly, the tab 18*a* comprises raised ring-like, finger engageable portions 22*a* and 30*a* which extend through the tab operating opening 24*a* and the dispensing opening 14*a* respectively. Note that the upper portion of the finger engageable portion 22*a* is flattened or flared outwardly after assembly in the end panel 12*a* as is the rivet-like portion 34*a* extending through the opening 17*a* at the point of pivotal attachment 16*a* thereby assuring that the tab 18*a* is appropriately retained within the tab operating opening 24*c* and the rivet opening on the end panel. Note further the instructional indicia on the top of the tab 18*a*.

Reference will now be made to FIGS. 6–8 wherein an embodiment of the invention similar to that shown in FIGS. 1–5 is disclosed. In the embodiment of FIGS. 6–8, the can end 112 is also attached to a can body 110 by double seaming and the can end 112 comprises a dispensing opening 114, a tab operating opening 124 and a hole at the pivotal point of attachment 116. The tab 118 is integrally formed from a plastic material such as polypropylene, polyethylene, polyesters, nylons or other similar materials which are in sealing engagement with the under side of the end panel 112 adjacent the dispensing opening 114, the tab operating opening 124 and the hole at the pivotal point of attachment 116. In this connection, it may be seen in FIGS. 7 and 8 that the tab 118 comprises a sealing portion 126 which extends outwardly at the openings and holes. The sealing portion 126 may be ultrasonically sealed to the under side of the end panel 112. In the alternative, an adhesive may be applied to the under side of the end panel 112 including a pressure or heat sensitive coating such as that utilized on the foresaid commercially available tape.

The tab 118 includes a raised portion 130 at the dispensing opening 114 so as to permit the tab to be pushed downwardly at the dispensing opening 114 thereby breaking the seal prior to pivoting the tab to an open position. Pivoting is accomplished by use of the finger engageable portion 122 which extends outwardly through the tab operating opening 124 and is of sufficiently small dimensions so as to permit it to be moved from the closed position shown in FIG. 6 to an open position on the other side of the tab operating opening 124. Rivet 134 extends through the hole at the point of pivotal attachment 116.

Unlike the previous embodiments, the edges 132 of the dispensing opening 114 and the tab operating opening 124 are hemmed under on the interior side of the end panel 112 as is also true, to a lesser extent, in the embodiment of FIGS. 5*a* and 5*b*. As shown, the edges of the dispensing opening 114 and the tab operating opening 124 actually face away from the openings so as to provide further protection to the finger. In contrast, the edges of the attachment hole 117 are curled upwardly toward the exterior side of the panel 112 such that the flared portion of the rivet 134 engages the edge of the end panel at the attachment hole 117.

As in the previous embodiment, the method of opening involves a two-step operation whereby pressure is applied to the raised portion 130 so as to break the seal at the dispensing opening 114 and to a lesser extent break the seal at the tab operating opening 124. Pressure may then be applied to the raised portion 122 in a plane substantially parallel to the plane of the end panel so as to pivot the tab 118 about the point of attachment 116 using the mechanical advantage of the lever arm from the point of attachment 116 to the raised portion 122 to break the seal adjacent the rivet 134.

In the embodiment of FIGS. 6–8, protection is also provided against accidental opening of the can end. As best shown in FIG. 6, a raised portion 136 extends on both sides of the openings in the end panel 112 as well as around the point of pivotal attachment 116.

Referring to the embodiment of FIGS. 9–12, the end panel 212 comprises a dispensing opening 214 and a small vent hole 217 adjacent the point of pivotal attachment 216. The closure tab 218 comprises an interior closure portion 220 which sealingly engages the under side of the end panel 212 adjacent the dispensing opening 214, the point of pivotal attachment 216 and the vent hole 217. In addition, the tab comprises an exterior finger engageable portion 222 which extends from a point of attachment at the pivotal point 216 to a position over the dispensing opening 214. The finger engageable portion 222 comprises a projection 240 which is capable of extending into the dispensing opening 214 so as to break the seal of the closure portion 220 with the interior side of the end panel 212. Once the seal at the dispensing opening 214 is broken, the finger engageable portion 222 may be pivoted above the exterior of the end panel with the resulting pivoting of the closure portion 220 which is attached thereto by an essentially square rivet 234 which is integrally formed with the closure portion 220. Once again, the mechanical advantage afforded by the fin er engageable portion 222 is capable of breaking the seal which remains adjacent the point of pivotal attachment 216 and adjacent the vent hole 217. As in the embodiment of FIGS. 1–5, the closure portion 220 comprises a flexible tape-like sealing member 226 which extends outwardly beyond the edges of a relatively rigid metallic member 228 which includes the integrally formed rivet 234. Since the rivet 234 is essentially square in cross-section, any slippage between the rivet 234 and the finger engageable portion 222 is prevented.

Note that the end panel 212 also includes raised portions 236 on opposite sides of the dispensing opening 214. Raised portions 236 assist in preventing inadvertent opening of the can end while also providing additional strength in the end panel 212. With the height of the raised portions 236 in the end panel 212, it may be necessary to actually lift the finger engageable portion 222 to a sufficient height above the raised portions 236 when pivoting the tab to the open position so as to clear the raised portions 236. Of course, such pivoting occurs after the seal at the dispensing opening has been broken as shown in FIG. 11.

A slightly modified version of the can end shown in FIGS. 9–12 will now be described with reference to FIGS. 13–15. As shown in FIGS. 14 and 15, a rivet 334 having an irregular shape is provided so as to permit a modest amount of play between the finger engageable portion 322 and the closure portion 320 of the can end 312. In this connection, the rivet 334 has a flat side 342 which is permitted to twist in an opening 344 in the closure portion 320 of the tab. When the rivet 334 has twisted to the position shown in phantom in FIG. 15, the finger engageable portion 322 of the tab is permitted to swing a pivot to the position shown in phantom about an axis substantially perpendicular to the plane of the end panel and substantially parallel to the axis of the can body. At that point, the play or slack between the rivet 334 and the opening 344 is expended or used up and further pivoting of the finger engageable portion 322 will produce movement of the closure portion 320. In this embodiment, protection against inadvertent opening of the can end is provided by a single raised portion 336.

The embodiment of FIGS. 16–18 is substantially identical to the embodiment of FIGS. 9–12 except that a single raised portion 436 is utilized in the end panel 412 and the raised portion 436 includes an inclined surface 446 which is adapted to cooperate with the hemmed edge 448 of the finger engageable portion 422 as shown in FIGS. 17 and 18. More particularly, pushing the finger engageable portion 422 downwardly produces a pivotal action due to the action of the edge 448 on the surface 446. Simultaneously, the seals between the tape 426 of the closure portion 420 and the end panel 412 is broken when the raised portion 440 contacts the metallic member 428. The combined downward and pivotal motion is particularly effective in opening the can end.

The embodiment of FIGS. 19–21 is substantially identical to the embodiment of FIGS. **5*a* and 5*b* except that the relatively rigid member 528 of a tab 518 including a closure portion 520 and a raised finger engageable portion 522 comprises plastic rather than sheet metal. Tab 518 further comprises a rivet-like portion 534 which extends through the point of pivotal attachment 516 of an end panel 512**.

As in the embodiment of FIGS. 1–5, the end panel 512 includes a dispensing opening 514 through which the raised portion 530 extends and a tab operating opening 524 through which the finger engageable portion 522 extends. Note that a raised protective portion 536 which extends above the raised portion 535 and the raised portion 530 of the tab at the dispensing opening 514 extends substantially around the tab 518 so as to assist in the prevention of accidental opening. As shown in FIGS. 20 and 21, the tab 518 is sealed to the interior side of the end panel 512 by means of a flexible tape-like member 526 which extends outwardly beyond the edges of the tab 518 and into sealing engagement with the interior side of the panel.

It will be noted that the edges of the end panel 512 at the dispensing opening 514 and the tab operating opening 524 are hemmed under as in the embodiment of FIGS. 6–8 such that the edges face away from the openings. Furthermore, the edge of the panel 512 engage the flared portion of the rivet 534. Also, the rigid member is recessed into the raised area 530 such that the interior surface thereof is substantially coplanar with the surrounding area of the end panel to permit a substantially planar application of the tape-like member 526.

As shown in FIGS. 22–26, a closure tab 618 differs in a number of important respects from the previous embodiments, but the end panel 612 is otherwise similar to the end panels previously described. One very important feature of the tab 618 involves the finger engageable portion 622 which is asymmetrically located with respect to the tab operating opening 624. More specifically, the finger engageable portion 622 includes a flared portion 623 which is spaced outwardly extending laterally beyond the periphery of the tab operating opening 624 only in the direction generally toward the point of pivotal attachment 616 at the rivet 634. As best shown in FIG. 25, the flared portion 623 which extends only toward the point of pivotal attachment 616 at the rivet 634 allows the tab 618 including the relatively rigid plastic portion 628 to be pushed and bent inwardly or downwardly so as to assure that the raised portion 630 of the tab 618 clears the periphery of the dispensing opening 614 to permit pivoting in a plane substantially parallel to the end panel 612 as shown in FIG. 23. The finger engageable portion 622 also includes a roughened surface in the form of ribs 650 which extend generally toward the point of pivotal attachment 616. These ribs 650 are best seen with reference to FIGS. 22, 23 and 26.

A related feature involves the rivet 634 which comprises a flared portion or head which is spaced from the main portion of the rigid plastic member 628 by an elongated neck 652 above the upwardly curled periphery of the hole 617. As best understood by comparing FIGS. 24 and 25, the elongated neck 652 allows the tab 618 to be pushed axially toward the interior of the can along the length thereof until the head engages the periphery of the hole 617 thereby allowing the raised portion 630 to clear the periphery of the dispensing opening 614 without substantial bending of the rigid member 628. As also shown in FIGS. 24 and 25, the flexible tape-like member 626 is actually separated from the end panel 612 along the entire length thereof including the area in the vicinity of the point of pivotal attachment 616.

As in the previous embodiments, the edge of the dispensing opening 614 and the tab operating opening 624 are hemmed under and the end panel includes a raised area 635 so as to permit the rigid members 628 to be substantially recessed such that the interiormost surface thereof is substantially coplanar with the surrounding area of the panel 612. This of course, as explained previously, permits the tape-like member 626 to remain in a substantially planar condition when sealingly engaging the end panel 612 as shown in FIGS. 24 and 26.

The embodiment of FIGS. 27–31 is similar to the embodiment of FIGS. 22–26 except for the size and function of the rivet 734. As perhaps best appreciated by comparing FIGS. 22 and 23 with FIGS. 27 and 28, it will be seen that the outer surface of the tab 734 is substantially larger than the outer surface of the rivet 734. This increase in size of the surface is provided so as to permit the rivet 734 to be utilized to perform a venting function. More specifically, the increase in size of the outer surface for the rivet 734 is adapted to be contacted by a finger which pushes the rivet 734 inwardly.

In the embodiment of FIGS. 27–31, the closure is opened in a three step operation. Before opening, the closure appears as shown in FIGS. 27 and 29 with the flexible tape-like member 726 sealed to the interior of the end panel 712. During the initial phase of opening, pressure or force is applied to the outer surface of the rivet 634 as depicted by the arrow $F_1$ in FIG. 30 so as to break the seal between the tape-like member 626 and the interior of the end panel 612 at or around the pivotal attachment opening 717. It will be observed that an elongated neck 752 is provided for the rivet 634 so as to permit movement of the rivet 734 prior to contact between the end panel and the flared portion of the rivet 734.

During the next phase of the opening operation, pressure or force $F_2$ is applied to the raised portion 730 of the closure portion which extends through the dispensing opening 714 as shown in FIG. 31. This time, the seal between the tape-like sealing member 626 and the interior of the end panel 612 is broken at and around the dispensing openings 714 as well as the tab-operating opening 624. It will be appreciated that the force required to break this seal at the dispensing opening 714 and the tab-operating opening 724 is greatly reduced in view of the fact that the container has been vented, and the force applied to the raised portion 634 need not overcome the internal pressure of the container. In this connection, it will be understood that the lesser area of the rivet 734 as compared with the closure portion 720 allows the application of less initial force in opening since total pressure applied to the interior of the closure tab at the rivet 734 is less than the total pressure applied to the interior of the closure portion 720.

As a third phase of the opening operation, the closure tab 718 is pivoted to the open position as shown in FIG. 28. This is accomplished by applying pivotal force to the finger engageable portion 722 while the flared portion 723 thereof engages the hemmed edge of the end panel at the tab operating opening 724.

As shown in FIGS. 29–31, the flared portion of the rivet 734 is relatively small. It should, however, be appreciated that the flared portion may be increased in size so as to increase the overall area of the outermost portion of the rivet thereby reducing the amount of external pressure per square inch which must be applied during venting of the container. The total pressure or force per square inch which must be applied for venting purposes may be further reduced by increasing the area of the elongated neck which connects the flared portion with the remainder of the closure tab 718. However, there are certain limits to increasing the size of the rivet which are imposed by assembly because of difficulties in inserting an enlarged rivet head through the hole 717. In this connection, relief areas 737 have been provided to allow the rivet head to be compressed radially inwardly.

As shown in FIGS. 27–31, the closure tab 718 comprises a plastic material which is relatively rigid but capable of the deformation illustrated in FIGS. 30 and 31. If a metal closure tab 718 were utilized, the rivet head could be formed after assembly.

It should also be appreciated that the flared portion of the rivet 734 serves to guard fingers from injury by the edge of the attachment opening or hole 717. Accordingly, one who opens such a container may push on the rivet 734 without fear of injury. Furthermore, since the rivet 734 is always retained in the hole 717, one need not be concerned with forcing his fingers into the interior of the container during venting as is possible with the embodiments of FIGS. 22–26. Consequently, there is no risk of displacing the liquid within the container during venting to the point that the liquid is forced outwardly through an opening.

It will be appreciated that the last two digits of the various reference characters utilized throughout this specification are always associated with elements performing essentially the same function. For example, the tab operating opening 624 of FIGS. 22 and 23 perform substantially the same function as the tab operating opening 24 of FIG. 1.

The can ends disclosed in the foregoing embodiments may of course comprise steel since there is no scoring or weakening of the can ends. However, it is not necessary that the end comprise steel and other alternatives including aluminum are suitable. In addition, specific materials have been suggested for use in the closure tabs. However, other materials may be utilized. It will therefore be understood that although specific embodiments of the invention have been shown and described and various modifications suggested, other embodiments and modifications will occur to those of ordinary skill in the art and will of course fall within the true spirit and scope of the invention as set forth in the appended claims.

What is claimed is:

1. A can of the easy-opening type comprising:

a can body;

an end panel attached to said can body and having a dispensing opening communicating between the interior and the exterior of said can body; and a closure tab pivotally attached to said end panel, said tab comprising a closure portion sealingly engaging said end panel on the interior side thereof adjacent said dispensing opening, said closure portion extending on the interior side of said end panel from said dispensing opening to the area of pivotal attachment of said tab to said end panel, said tab further comprising a finger engageable portion located on the exterior of said end panel so as to permit said closure portion to be pivoted from the closed position to the open position, said dispensing opening and said tab permitting said closure portion to be pushed inwardly so as to break the seal between said closure portion and said end panel during opening while said finger engageable portion remains on the exterior side of said end panel thereby facilitating subsequent pivoting of said closure tab about an axis substantially parallel to the axis of the can body.

2. The can of claim 1 wherein said closure portion is sealingly engaged at the area of pivotal attachment of said tab to said end panel prior to pivoting the closure portion from said closed position to said open position.

3. The can of claim 2 wherein said closure tab comprises a flexible tape-like member on the interior side of said closure member for sealingly engaging the interior side of said end panel.

4. The can of claim 1 wherein said finger engageable portion extends along the exterior of said end panel away from the pivotal point.

5. The can of claim 4 wherein said finger engageable portion extends over said dispensing opening and cooperates therewith when pushed toward the interior of the can so as to break the seal between said closure portion and the interior side of said end panel.

6. The can of claim 5 wherein said finger engageable portion includes a projection capable of extending into said dispensing opening.

7. The can of claim 6 further comprising sealing means associated with said closure portion for isolating the point of pivotal attachment from the interior of said can body.

8. The can of claim 7 further comprising a vent hole in said end panel covered by said closure portion when said tab is in the closed position, said vent hole being isolated from the interior of said can body by said sealing means prior to moving said closure tab to the open position.

9. The can of claim 4 wherein said end panel includes an outwardly raised area adjacent said closure portion so as to protect against accidental opening.

10. The can of claim 4 wherein said end panel includes an outwardly raised area adjacent said closure portion and having an inclined surface cooperating with said finger engageable portion for producing a pivotal motion of said closure tab as said finger engageable portion is pushed inwardly toward said closure portion to break the seal at said dispensing opening.

11. The can of claim 1 wherein said end panel includes a tab operating opening located between said dispensing opening and the point of pivotal attachment, said finger engageable portion extending through said tab operating opening.

12. The can of claim 11 wherein said closure portion comprises a rigid member and a flexible tape-like member covering said closure portion on the interior side thereof and in sealing engagement with the interior side of said end panel when said closure tab is in the closed position.

13. The can of claim 11 wherein said closure tab comprises a plastic material and said closure portion is integrally formed with said finger engageable portion.

14. The can of claim 11 wherein said finger engageable portion includes a segment extending laterally beyond the periphery of said tab operating opening on the exterior side of said end panel so as to be retained on the exterior side of said end panel after opening.

15. The can of claim 14 wherein the exterior side of said finger engageable portion comprises a roughened surface to assist in finger engagement.

16. The can of claim 15 wherein said segment is spaced outwardly from said end panel so as to permit said closure portion to be pushed inwardly prior to contact of said segment with said end panel.

17. The can of claim 14 wherein said segment is asymetrically located with respect to said tab operating opening.

18. The can of claim 17 wherein said segment extends toward said point of pivotal attachment.

19. The can of claim 13 wherein the exterior side of said finger engageable portion comprises a roughened surface to assist in finger engagement.

20. The can of claim 1 wherein said end panel includes a raised area around said dispensing opening and said pivotal point of attachment, said closure tab being recessed upwardly in said raised area.

21. The can of claim 20 wherein said tab comprises a rigid member having an interiormost surface substantially coplanar with the interior surface of said end panel surrounding said raised area.

22. The can of claim 21 wherein said tab further comprises a flexible tape-like member extending over said interiormost surface and in sealing engagement with said surrounding area.

23. The can of claim 22 wherein said rigid member comprises a plastic material.

24. The can of claim 22 wherein said rigid member comprises sheet metal.

25. The can of claim 20 wherein the edges of said dispensing opening are hemmed under at the interior such that the edges of said end panel at said opening faces substantially away from said dispensing opening.

26. The can of claim 25 further comprising a tab operating opening located between said dispensing opening and the point of pivotal attachment, said finger engageable portion extending through said tab operating opening.

27. The can of claim 26 wherein the edges of said tab operating opening are hemmed under at the interior such that the edge of said end panel at said tab operating opening face substantially away from said tab operating opening.

28. The can of claim 1 wherein said end panel comprises an attachment opening at said point of said pivotal attachment and said tab comprises an outwardly extending attachment portion extending outwardly through said attachment opening.

29. The can of claim 28 wherein said attachment portion comprises a flared portion located on the exterior of said end panel.

30. The can of claim 29 wherein said attachment portion comprises an elongated neck so as to permit movement of said neck axially through said attachment opening.

31. The can of claim 29 wherein said attachment portion comprises an outer surface adapted to be pushed inwardly for venting the can prior to pushing said closure portion inwardly.

32. The can of claim 31 wherein said attachment portion comprises an elongated neck so as to permit movement of said neck axially through said attachment opening when said outer surface of said attachment portion is pushed inwardly.

33. The can of claim 29 wherein said end panel is curled upwardly toward the exterior side thereof at said attachment opening such that said flared portion engages the edge of said end panel at said attachment opening.

34. The can of claim 11 wherein said finger engageable portion includes a flared section on the exterior side of said end panel for retaining said finger engageable portion in said tab operating opening when said closure portion is pushed inwardly.

35. The can of claim 12 wherein said finger engageable portion comprises a rigid member connected to said closure portion, said finger engageable rigid member including a flared section on the exterior side of said end panel for retaining said finger engageable rigid member in said tab operating opening when said closure portion rigid member is pushed inwardly.

36. The can of claim 13 wherein said finger engageable portion includes a flared section on the exterior side of said end panel for retaining said finger engageable portion in said tab operating opening when said finger engageable portion is pushed inwardly.

37. The can of claim 1 wherein said end panel comprises at least one outwardly raised area adjacent said finger engageable portion and said tab operating opening so as to protect against accidental opening of said can.

38. A method of opening an easy-opening type can comprising a can body, an end panel attached to said body with a dispensing opening communicating with the interior of the can body, and a closure tab pivotally attached to said end panel, said closure tab having a closure portion sealingly engaging said end panel on the interior side thereof adjacent said dispensing opening, said closure tab also having a finger engageable portion, the method comprising:

pushing said closure tab inwardly at said dispensing opening to break said seal between said closure portion and said end panel, and pivoting said closure tab in a plane substantially parallel to said end panel by engaging said finger engageable portion at the exterior of said end panel after said seal has been broken.

39. The method of claim 38 including the step of pushing said closure tab inwardly at the point of attachment for venting said can body before pushing said closure tab inwardly at said dispensing opening.

40. A closure for a container of the easy-opening type comprising:

a panel having a dispensing opening, a tab operating opening and an area of pivotal attachment; and a closure tab pivotally attached to said panel at said area of pivotal attachment so as to pivot about an axis substantially perpendicular to the plane of said panel, said tab including a closure portion extending along the interior side of said panel so as to cover and seal said dispensing opening and said tab operating opening when said closure tab is in the closed position, said tab further comprising a finger engageable portion adapted to extend through said tab operating opening before and after said closure portion has been pushed inwardly at said dispensing opening for use in pivoting said closure portion to the open position about said axis.

41. The closure of claim 40 wherein said area of pivotal attachment comprises a pivot opening, said closure tab including a pivot portion extending through said pivot opening.

42. The closure of claim 41 wherein said pivot portion extends outwardly through said pivot opening a sufficient distance so as to permit the pivot portion to be pushed inwardly from the exterior of said end panel.

43. The closure of claim 42 wherein said pivot portion comprises a flared portion located on the exterior of said end panel.

44. The closure of claim 43 wherein said pivot portion comprises an elongated neck so as to permit movement of said neck axially through said attachment opening.

45. The closure of claim 40 wherein said finger engageable portion and said tab operating opening includes a flared section on the exterior side of said panel to retain said finger engageable portion in said tab operating opening when said closure portion is pushed inwardly at said dispensing opening.

46. The closure of claim 40 wherein said closure portion extends upwardly through said dispensing opening.

47. The closure of claim 40 wherein said tab operating opening is located generally between said dispensing opening and said area of pivotal attachment.

48. The closure of claim 40 wherein said area of pivotal attachment comprises a pivot opening, said closure tab including a pivot portion extending through said pivot opening.

49. The closure of claim 48 wherein said closure tab comprises plastic and said finger engageable portion and said pivot portion are integrally formed therefrom.

50. The closure of claim 49 wherein said closure portion extends upwardly through said dispensing opening.

51. The closure of claim 50 wherein said closure tab further comprises a flexible tape-like member covering said closure tab on the interior side thereof and in sealing engagement with the interior side of said panel when said closure tab is in the closed position.

52. The closure of claim 51 wherein said finger engageable portion in said tab operating opening includes a flared section on the exterior side of said panel to retain said finger engageable portion in said tab operating opening when said closure portion is pushed inwardly at said dispensing opening.

53. The closure of claim 40 wherein said finger engageable portion includes a segment extending laterally beyond the periphery of said tab operating opening on the exterior side of said panel so as to be retained on the exterior side of said panel after opening.

54. The closure of claim 53 wherein the exterior side of said finger engageable portion comprises a roughened surface to assist in finger engagement.

55. The closure of claim 54 wherein said segment is spaced outwardly from said panel so as to permit said closure portion to be pushed inwardly prior to contact of said segment with said panel.

56. The closure of claim 53 wherein said segment is asymetrically located with respect to said tab operating opening.

57. The closure of claim 56 wherein said segment extends toward said point of pivotal attachment.

58. The closure of claim 40 wherein the exterior side of said finger engageable portion comprises a roughened surface to assist in finger engagememt.

59. The closure of claim 40 wherein said end panel includes a raised area around said dispensing opening and said pivotal point of attachment, said closure tab being recessed upwardly in said raised area.

60. The closure of claim 59 wherein said tab comprises a rigid member having an interiormost surface substantially coplanar with the interior surface of said panel surrounding said raised area.

61. The closure of claim 60 wherein said tab further comprises a flexible tape-like member extending over said interiormost surface and in sealing engagement with said surrounding area.

62. The closure of claim 61 wherein said rigid member comprises a plastic material.

63. The closure of claim 60 wherein said rigid member comprises sheet metal.

64. The closure of claim 40 wherein the edges of said dispensing opening are hemmed under at the interior such that the edge of end panel at said opening faces substantially away from said dispensing opening.

65. The closure of claim 64 wherein the edges of said tab operating opening are hemmed under at the interior such that the edge of said panel at said tab operating opening face substantially away from said tab operating opening.

66. The closure of claim 40 wherein said panel comprises an attachment opening at said point of said pivotal attachment and said tab comprises an outwardly extending attachment portion extending outwardly through said attachment opening.

67. The closure of claim 66 wherein said attachment portion comprises a flared portion located on the exterior of said panel for retaining said attachment portion within said attachment opening.

68. The closure of claim 67 wherein said attachment portion comprises an elongated neck so as to permit movement of said neck axially through said attachment opening.

69. The closure of claim 66 wherein said panel is curled upwardly toward the exterior side thereof at said attachment opening such that said flared portion engages the edge of said panel at said attachment opening.

70. A method of opening a container of the easy-opening type comprising a panel having a dispensing opening, a tab operating opening and an area of pivotal attachment for a closure tab, the tab including a closure portion sealingly engaging the panel on the interior side thereof adjacent the dispensing opening and the tab operating opening, the tab further including a finger engageable portion extending through the tab operating opening, the method comprising:

pushing said closure tab inwardly at said dispensing opening to break at least a portion of the seal between said tab closure and said end panel;

retaining at least some of said finger engageable portion extending through said tab operating opening after said pushing; and pivoting said closure tab about an axis substantially perpendicular to said panel by engaging the retained finger engageable portion at the exterior of said panel.

71. The method of claim 70 including the step of pushing said closure tab inwardly at the area of pivotal attachment for venting said container before pushing said closure tab inwardly at said dispensing opening.

72. A method of opening a container of the easy-opening type comprising a closure tab, a panel having a dispensing opening, a tab operating opening and an area of pivotal attachment for a closure tab, the tab including a closure portion sealingly engaging the panel on the interior side thereof adjacent the dispensing opening, the tab operating opening and the area of pivotal attachment, tab further including a finger engageable portion extending through the tab operating opening, the method comprising:

pushing said closure tab at the area of pivotal attachment inwardly for venting said container;

retaining at least some of said finger engageable portion extending through said tab operating opening after said pushing; and pivoting said closure tab about an axis substantially perpendicular to said panel by engaging the finger engageable portion at the exterior of said panel.

73. The method of claim 72 further comprising the step of pushing said closure tab inwardly at said dispensing opening to break at least a portion of the seal between said tab closure and said end panel after pushing said closure tab inwardly at the area of pivotal attachment.

* * * * *

UNITED STATES PATENT AND TRADEMARK OFFICE

CERTIFICATE OF CORRECTION

PATENT NO. : 4,078,695

DATED : March 14, 1978

INVENTOR(S) : Vinson S. Potts

It is certified that error appears in the above-identified patent and that said Letters Patent are hereby corrected as shown below:

Column 1, line 44, "Pushin" should read --push-in--.

Column 2, line 32, after "tab" insert --operating--.

Column 2, line 65, after "can" insert --end--.

Column 6, line 60, "fin er" should read --finger--.

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*